US008476563B2

(12) United States Patent
Gong et al.

(10) Patent No.: US 8,476,563 B2
(45) Date of Patent: Jul. 2, 2013

(54) INDUCTION HEATING COOKER AND CONTROL CIRCUIT THEREFOR

(75) Inventors: Pei-Min Gong, Taipei (TW); Ming-Chun Chou, Banciao (TW); Hsiu Ju Yang, Tai Chung (TW)

(73) Assignee: Elan Microelectronics Corp., Hsin-Chu (TW)

( * ) Notice: Subject to any disclaimer, the term of this patent is extended or adjusted under 35 U.S.C. 154(b) by 1310 days.

(21) Appl. No.: 12/242,341

(22) Filed: Sep. 30, 2008

(65) Prior Publication Data

US 2009/0173732 A1 Jul. 9, 2009

(30) Foreign Application Priority Data

Jan. 7, 2008 (TW) ..... 97100519 A

(51) Int. Cl.

| | |
|---|---|
| ***H05B 6/04*** | (2006.01) |
| ***H05B 6/06*** | (2006.01) |
| ***H05B 6/08*** | (2006.01) |
| ***H05B 6/14*** | (2006.01) |

(52) U.S. Cl.

USPC ..... 219/661; 219/663; 219/664; 219/665; 219/626

(58) Field of Classification Search

USPC ..... 219/620, 625, 626, 627, 660, 661, 219/663, 664, 665, 667, 702, 715, 716; 99/DIG. 14; 363/50, 55, 97, 131; 323/235, 236, 319

See application file for complete search history.

(56) References Cited

U.S. PATENT DOCUMENTS

| | | | | |
|---|---|---|---|---|
| 4,356,371 | A * | 10/1982 | Kiuchi et al. | 219/626 |
| 5,019,907 | A * | 5/1991 | Murakoshi et al. | 348/542 |
| 5,376,775 | A * | 12/1994 | Lee | 219/665 |

* cited by examiner

*Primary Examiner* — Quang Van
*Assistant Examiner* — Hung D Nguyen
(74) *Attorney, Agent, or Firm* — Muncy, Geissler, Olds & Lowe, PLLC

(57) ABSTRACT

An induction heating cooker includes a switch element and an inductive coil, which is coupled between a power voltage and a first terminal of the switch element. A second terminal of the switch element is coupled to a common voltage. A control circuit for controlling the inducting heating cooker includes first and second comparators and a pulse generator. The first comparator receives voltages of two terminals of the inductive coil and thus outputs a trigger signal. The second comparator receives a reference voltage and a voltage of the first terminal of the switch element, and enables a fading signal when the voltage of the first terminal is higher than the reference voltage. When the trigger signal is enabled, the pulse generator outputs a pulse to control the switch element. When the fading signal is enabled, the pulse generator reduces a pulse width of the pulse.

44 Claims, 4 Drawing Sheets

INDUCTION HEATING COOKER AND CONTROL CIRCUIT THEREFOR

This application claims priority of No. 097100519 filed in Taiwan R.O.C. on Jan. 7, 2008 under 35 USC 119, the entire content of which is hereby incorporated by reference.

BACKGROUND OF THE INVENTION

1. Field of Invention

The invention relates to an induction heating cooker, and more particularly to an induction heating cooker and a control circuit therefor.

2. Related Art

With the recent progress of the technology, an induction heating cooker has become an indispensable electronic appliance for the modern human beings. The induction heating cooker is the kitchenware for converting the electric energy into the thermal energy according to the electromagnetic induction principle. In the induction heating cooker, a rectification circuit transforms an AC voltage with the frequency of 50/60 Hz into a DC voltage, and then a control circuit transforms the DC voltage into a high-frequency voltage with the frequency ranging from 20 to 40 KHz. The rapidly changing current flows through the coil so that the rapidly changing magnetic field is generated. When the line of magnetic force in the magnetic field passes through the metal pan, especially made of the magnetic-conductive and electro-conductive material, many small vortexes are generated in the bottom metal body so that the pan itself generates heat rapidly to heat the article in the heater.

FIG. 1 is a circuit block diagram showing a conventional induction heating cooker. Referring to FIG. 1, the induction heating cooker includes an inductive coil 10, a capacitor 11, a bridge rectifier 12, an insulated gate bipolar transistor (IGBT) 13 and a control circuit 14, which includes a pulse generator 141, a comparator 142 and firmware 143. The firmware 143 mainly functions to control the pulse generator 141. The user controls the output power and the on/off switch on the control panel of the induction heating cooker to operate the cooker. The firmware 143 controls the operation of the pulse generator 141 according to the operation of the user. When the user sets the output power as "high", the firmware 143 controls the pulse generator 141 to output the pulse with the wider pulse width to the IGBT 13. When the user sets the output power as "weak", the firmware 143 controls the pulse generator 141 to output the pulse with the narrower pulse width to the IGBT 13.

When the induction heating cooker starts, the pulse generator 141 firstly outputs a first pulse to the IGBT 13 to turn on the IGBT 13. Because two input terminals of the comparator 142 are respectively coupled to two terminals of the inductive coil 10, the inductive coil 10 and the capacitor 11 start to oscillate after the IGBT 13 turns on and then off. Thus, the output of the comparator 142 is changed from the original negative saturation voltage to the positive saturation voltage. Each time when the pulse generator 141 receives the pulse, which is outputted from the comparator 142 and has the positive saturation voltage, it again outputs the pulse to the IGBT 13.

In addition, the firmware 143 also provides the protecting function. When the load pan is removed from the induction heating cooker, the energy of the inductive coil 10 cannot be released so that the voltage at the node A of the IGBT 13 is too high. Thus, the width of the outputted pulse has to be reduced. When the firmware 143 detects the too high voltage at the node A, it controls the pulse generator 141 to reduce the width of the outputted pulse. In addition, when the firmware 143 has detected a sudden rise of the voltage at the node B or C of the bridge rectifier 12, it represents that a surge occurs. At this time, the firmware 143 controls the pulse generator 141 to stop outputting pulses.

However, the firmware 143 needs a predetermined period of judging time, during which the energy caused by the inductive coil 10 cannot be released so that the voltage at the node A continuously rises. When the voltage drop of the IGBT 13 exceeds a predetermined voltage, such as 1200 Volts typically, the induction heating cooker may burn out.

SUMMARY OF THE INVENTION

It is therefore an object of the invention to provide an induction heating cooker and a control circuit therefor in order to prevent internal elements of the induction heating cooker from burning out, to simplify the production flow and to reduce the element cost.

To achieve the above-identified or other objects, the invention provides an induction heating cooker. The induction heating cooker includes an inductive coil, a switch element and a control circuit. A first terminal of the inductive coil is coupled to a power voltage. A first terminal of the switch element is coupled to a second terminal of the inductive coil. A second terminal of the switch element is coupled to a common voltage. The control circuit includes a first comparator, a second comparator and a pulse generator. The first comparator has a first input terminal coupled to the first terminal of the inductive coil, a second input terminal coupled to the second terminal of the inductive coil, and an output terminal for outputting a trigger signal. The second comparator has a first input terminal coupled to a first reference voltage, a second input terminal coupled to the first terminal of the switch element, and an output terminal for outputting a fading signal. When a voltage of the second input terminal of the second comparator is higher than the first reference voltage, the second comparator enables the fading signal. The output terminal of the pulse generator is coupled to a control terminal of the switch element. When the trigger signal is enabled, the output terminal of the pulse generator outputs a pulse to control the switch element. When the fading signal is enabled, the pulse generator reduces a pulse width of the outputted pulse.

In the induction heating cooker and the control circuit therefor according to the embodiment of the invention, the induction heating cooker further includes a rectifier. This rectifier may be a bridge rectifier, which includes a first terminal, a second terminal, a third terminal and a fourth terminal. The first terminal and the second terminal of the bridge rectifier are coupled to an AC voltage source, the third terminal of the bridge rectifier outputs the power voltage, and the fourth terminal of the bridge rectifier outputs the common voltage. In one embodiment, the control circuit further includes a third comparator, which has a first input terminal coupled to a second reference voltage, a second input terminal selectively coupled to the first terminal or the second terminal of the bridge rectifier, and an output terminal for outputting a stop signal, which is enabled when a voltage of the second input terminal is higher than the first reference voltage. The pulse generator is coupled to the output terminal of the third comparator, receives the stop signal, and stops outputting the pulse when the stop signal is enabled.

In the induction heating cooker and the control circuit therefor according to the embodiment of the invention, the control circuit further includes a low-pass filter. The low-pass filter is coupled between the output terminal of the first comparator and the pulse generator, and is for filtering noise of the trigger signal. In one embodiment, the control circuit further includes a first register for storing duty cycle data, and a second register for storing difference data, and the pulse generator determines a duty cycle of the pulse according to the duty cycle data. When the fading signal is enabled, the pulse generator determines the duty cycle of the pulse by subtracting the difference data from the duty cycle data.

In the induction heating cooker and the control circuit therefor according to the embodiment of the invention, the control circuit includes a load pan detecting circuit, which is coupled to the pulse generator, receives the pulse, and judges a size of a load pan according to a cycle of the pulse within a predetermined time. In one embodiment, the control circuit further includes a pulse phase control circuit, which is coupled to the pulse generator and is for controlling the pulse outputted from the pulse generator to have a high potential or a low potential.

In the induction heating cooker and the control circuit therefor according to the embodiment of the invention, the pulse generator includes a fading control terminal and a stop control terminal, and the control circuit further includes a switch circuit. The switch circuit has a first input terminal coupled to the output terminal of the second comparator, a second input terminal coupled to the output terminal of the third comparator, a first output terminal coupled to the fading control terminal, and a second output terminal coupled to the stop control terminal. When the second input terminal of the second comparator is coupled to the first terminal of the switch element and the second input terminal of the third comparator is coupled to the bridge rectifier, a circuit between the first input terminal and the first output terminal of the switch circuit is turned on, and a circuit between the second input terminal and the second output terminal of the switch circuit is turned on. When the second input terminal of the second comparator is coupled to the first terminal or the second terminal of the bridge rectifier, and the second input terminal of the third comparator is coupled to the first terminal of the switch element, a circuit between the first input terminal and the second output terminal of the switch circuit is turned on, and a circuit between the second input terminal and the first output terminal of the switch circuit is turned on. In one embodiment, the switch element is an IGBT. In one embodiment, the induction heating cooker further includes a capacitor. Two terminals of the capacitor are respectively coupled to the two terminals of the inductive coil.

The spirit of the invention is to integrate the comparators and the pulse generator in one single chip. The condition of the too slow response speed of pulse width modulation controlled by software and the microprocessor can be improved, the system design and the production flow can be simplified, and the production yield can be advantageously increased. In the present technology, no integrated structure is applied to the dedicated single chip of the charger.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

The present invention will be apparent from the following detailed description, which proceeds with reference to the accompanying drawings, wherein the same references relate to the same elements.

Figure 1:
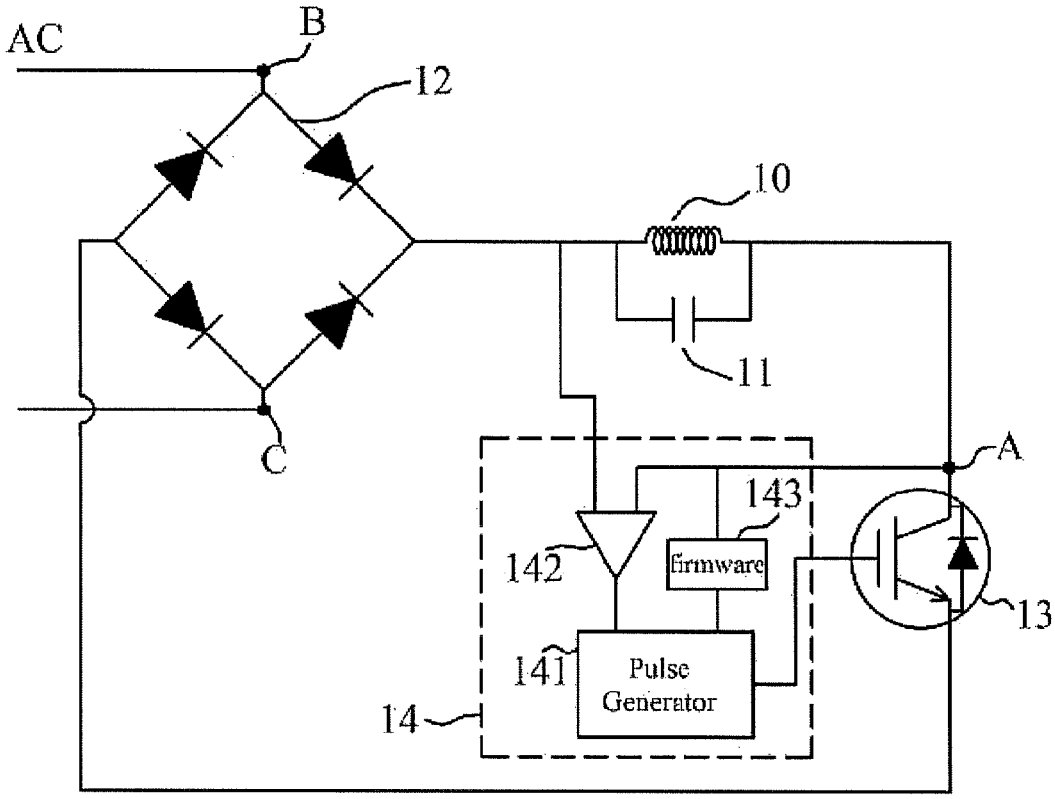
FIG. 1 (Prior Art)
FIG. 1 is a circuit block diagram showing a conventional induction heating cooker.
Figure 2:
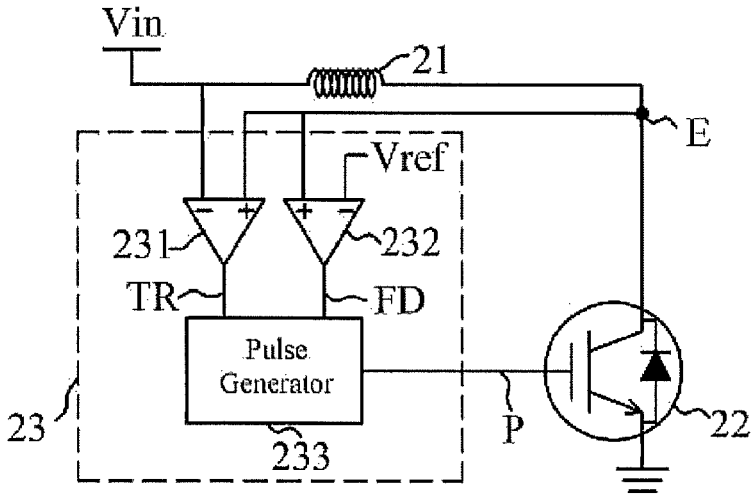
FIG. 2 is a circuit block diagram showing an induction heating cooker according to a first embodiment of the invention.

FIG. 2 is a circuit block diagram showing an induction heating cooker according to a first embodiment of the invention. Referring to FIG. 2, the induction heating cooker includes an inductive coil 21, a switch element 22 and a control circuit 23 for the induction heating cooker according to the embodiment of the invention. The control circuit 23 includes a first comparator 231, a second comparator 232 and a pulse generator 233. The circuit connection relationship of the induction heating cooker is shown in the drawing.

Figure 3:
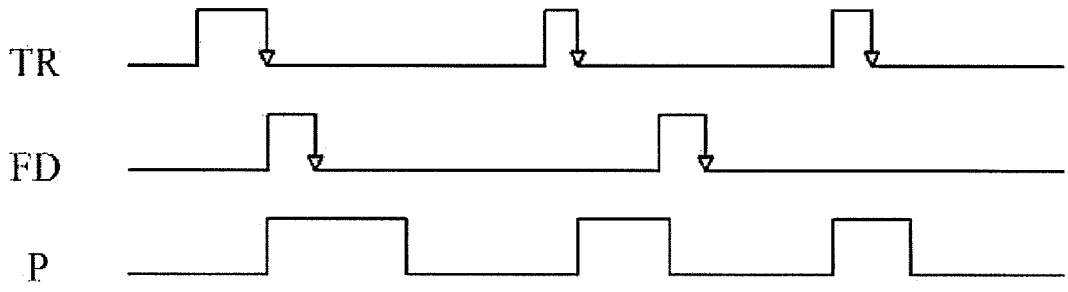
FIG. 3 shows operation waveforms of the induction heating cooker according to the first embodiment of the invention.

FIG. 3 shows operation waveforms of the induction heating cooker according to the first embodiment of the invention. Referring to FIGS. 2 and 3, when a user starts this induction heating cooker, the pulse generator 233 outputs a starting pulse P to turn on the switch element 22. This current flows through the inductive coil 21. After the switch is turned off for a predetermined time, voltages at two terminals of the coil change to make a trigger signal TR, which is outputted from the first comparator 231, change from a negative saturation voltage to a positive saturation voltage. Thereafter, the trigger signal TR is changed from the positive saturation voltage to the negative saturation voltage. When the trigger signal TR is changed from the positive saturation voltage to the negative saturation voltage, the pulse generator 233 again outputs a pulse P to turn on the switch element 22.

When the induction heating cooker is operating and the user suddenly removes the load pan from the cooker, the energy stored in the inductive coil 21 cannot be released instantaneously so that the voltage at the node E of the switch element 22 is increased. In the embodiment of the invention, a first input terminal of the second comparator 232 is coupled to a reference voltage Vref, and a second input terminal of the second comparator 232 is coupled to the node E of the switch element 22. When the voltage at the node E is higher than the reference voltage Vref, a fading signal FD outputted from the second comparator 232 is enabled. When the pulse generator 233 detects that the fading signal FD is enabled, it reduces the pulse width of the next pulse P so that the voltage at the node E is decreased to prevent the switch element 22 from burning out.

Although one possible aspect of the induction heating cooker and the control circuit thereof has been mentioned in the embodiment, it is to be noted that the design and the connection of the control circuit 23 for the induction heating cooker may be modified by different manufacturers. So, the application of the invention is not restricted to this possible aspect. In other words, the spirit of the invention may be satisfied as long as at least one comparator 212 is built in the control circuit 23, wherein the comparator 212 is for comparing the reference voltage Vref with the feedback voltage of the switch element 22 to determine whether the pulse width of the pulse P is to be reduced or closed.

In addition, one of ordinary skill in the art may understand that a voltage dividing means are provided between the first comparator 231 and the second comparator 232 and the inductive coil 21 because the voltage difference between the two terminals of the inductive coil 21 is higher than that of the control circuit 23. The voltage dividing means are provided to prevent the voltage difference between the two terminals of the inductive coil 21 from becoming too high and to prevent the control circuit 23 from burning out. So, detailed descriptions are not described in the above-mentioned embodiment.

Several embodiments will be illustrated to make one of ordinary skill in the art understand the spirit of the invention and implement the invention easily.

Figure 4A:
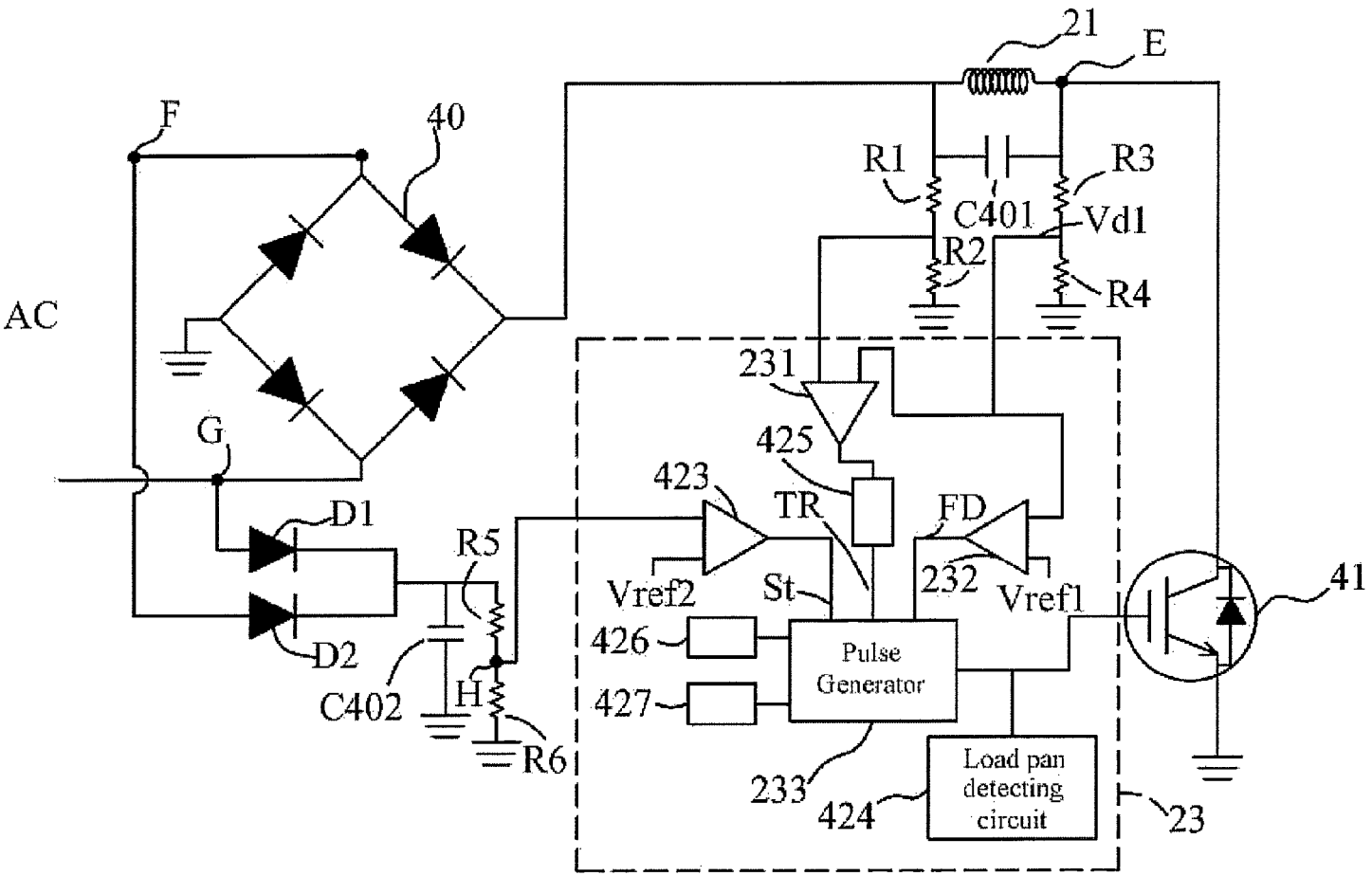
FIG. 4A is a circuit block diagram showing an induction heating cooker according to a second embodiment of the invention.

FIG. 4A is a circuit block diagram showing an induction heating cooker according to a second embodiment of the invention. As shown in FIG. 4A, the switch element 22 is implemented by an insulated gate bipolar transistor (IGBT) 41 in this embodiment. In addition, the control circuit 23 further includes a third comparator 423, a load pan detecting circuit 424, a low-pass filter 425, a first register 426 and a second register 427. In order to describe this embodiment in detail, the control circuit further includes capacitors C401 and C402, a bridge rectifier 40, diodes D1 and D2 and resistors R1 to R6. The connection relationship of this circuit is shown in the drawing.

In this embodiment, the capacitor C401 resonates in conjunction with the inductive coil 21. When the induction heating cooker is operating, the pulse generator 233 determines the duty cycle of the pulse P according to the duty cycle data stored in the first register 426, and outputs the pulse P to the gate of the IGBT 41 to turn on the IGBT 41. Thereafter, the capacitor C401 and the inductive coil 21 resonate so that the trigger signal TR of the first comparator 231 starts to oscillate. When the trigger signal TR is changed from the logic high voltage to the logic low voltage, the pulse generator 233 again outputs a pulse P. When the user removes the load pan from the cooker, the voltage at the node E is increased because the energy of the inductive coil 21 cannot be released. When the divided voltage Vd1 at the node E is higher than the reference voltage Vref1, the fading signal FD outputted from the second comparator 232 is enabled. In addition, the pulse generator 233 acquires the duty cycle data stored in the first register 426 and the difference data stored in the second register 427, and then subtracts the difference data from the duty cycle data to determine the duty cycle of the subsequently outputted pulse P. The turn-on time of the IGBT 41 is correspondingly shortened after the duty cycle of the pulse P is reduced, so the voltage at the node E can be reduced.

Figure 4B:
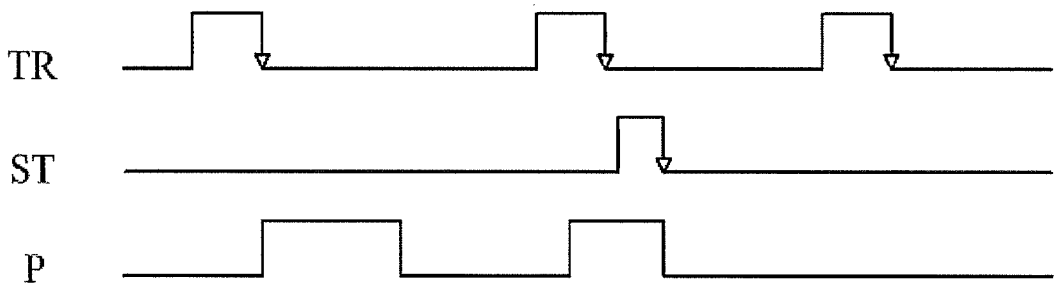
FIG. 4B shows operation waveforms of the induction heating cooker according to the second embodiment of the invention.

In addition, the rectifying and voltage dividing circuit, which is composed of the diodes D1 and D2, the capacitor C402 and the resistors R5 and R6, cannot work, and the voltage at the node H is not higher than the reference voltage Vref2. However, when the thunderbolt or interference occurs, the voltage at the node F or the node G instantaneously rises, as shown in FIG. 4B, so that the voltage at the node H is higher than the internal reference voltage Vref2. At this time, a stop signal St outputted from the third comparator 423 is enabled. When the stop signal St is enabled, the pulse generator 233 stops outputting the pulse P to prevent the circuit from burning out.

Figure 5:
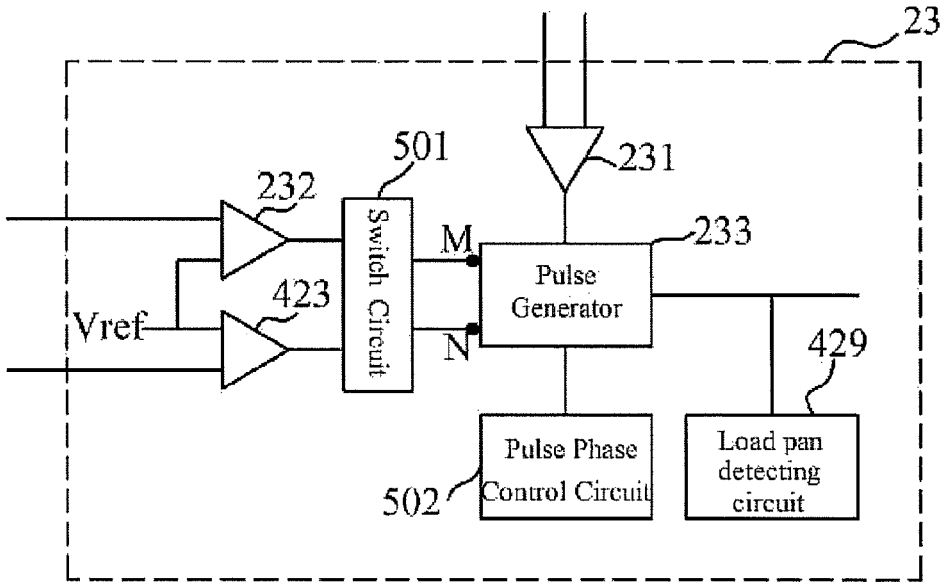
FIG. 5 is a circuit block diagram showing a control circuit 23 for an induction heating cooker according to a third embodiment of the invention.

FIG. 5 is a circuit block diagram showing the control circuit 23 for an induction heating cooker according to a third embodiment of the invention. As shown in FIG. 5, the control circuit further includes a switch circuit 501 and a pulse phase control circuit 502. The positions of the pins are fixed after the integrated circuit is packaged. However, the circuit layout becomes inconvenient due to the fixed positions of the pins. In this embodiment, the switch circuit 501 can exchange the output of the second comparator 232 with the output of the third comparator 423. As shown in FIGS. 4A, 4B and 5, when the second comparator 232 is to be coupled to the node H and the third comparator 423 is to be coupled to the node E, the output terminal of the second comparator 232 is coupled to the node M and is for outputting the stop signal St and the output terminal of the third comparator 423 is coupled to the node N and is for outputting the fading signal FD. When the second comparator 232 is to be coupled to the node E and the third comparator 423 is to be coupled to the node H, the output terminal of the second comparator 232 is coupled to the node N and is for outputting the fading signal FD, and the output terminal of the third comparator 423 is coupled to the node M and is for outputting the stop signal St.

In addition, some applications may need inverse pulses. So, the control circuit of this embodiment further includes the pulse phase control circuit 502 to provide two different phases of pulses for the normal low potential and the pulse high potential, and for the normal high potential and the pulse low potential.

In summary, the spirit of the invention is to integrate the comparators and the pulse generator in one single chip. The condition of the too slow response speed of pulse width modulation controlled by software and the microprocessor can be improved, the system design and the production flow can be simplified, and the production yield can be advantageously increased. In the present technology, no integrated structure is applied to the dedicated single chip of the charger.

In addition, the switch circuit 501 is coupled between the second comparator, the third comparator and the pulse generator 233 according to the embodiment of the invention. Therefore, the circuit layout may become more flexible.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. A control circuit for controlling an induction heating cooker, which comprises an inductive coil and a switch element, wherein the inductive coil is coupled between a power voltage and a first terminal of the switch element, and a second terminal of the switch element is coupled to a common voltage, the control circuit comprising:

a first comparator having a first input terminal coupled to a first terminal of the inductive coil, a second input terminal coupled to a second terminal of the inductive coil, and an output terminal for outputting a trigger signal;

a second comparator having a first input terminal coupled to a first reference voltage, a second input terminal coupled to the first terminal of the switch element, and an output terminal for outputting a fading signal, which is enabled when a voltage of the second input terminal is higher than the first reference voltage;

a pulse generator for outputting a pulse to control the switch element when the trigger signal is changed from a second logic level to a first logic level, and for reducing a pulse width of the pulse when the fading signal is enabled;

a bridge rectifier comprising a first terminal, a second terminal, a third terminal and a fourth terminal, wherein the first terminal and the second terminal of the bridge rectifier are coupled to an AC voltage source, the third terminal of the bridge rectifier outputs the power voltage, and the fourth terminal of the bridge rectifier outputs the common voltage; and a third comparator having a first input terminal coupled to a second reference voltage, a second input terminal selectively coupled to the first terminal or the second terminal of the bridge rectifier, and an output terminal for outputting a stop signal, wherein:

the stop signal is enabled when a voltage of the second input terminal is higher than the first reference voltage;

the pulse generator is coupled to the output terminal of the third comparator and receives the stop signal; and the pulse generator stops outputting the pulse when the stop signal is enabled.

2. The control circuit according to claim 1, further comprising:

a low-pass filter, which is coupled between the output terminal of the first comparator and the pulse generator and is for filtering out noise of the trigger signal.

3. The control circuit according to claim 1, further comprising:

a first register for storing duty cycle data; and a second register for storing difference data, wherein the pulse generator determines a duty cycle of the pulse according to the duty cycle data, and the pulse generator determines the duty cycle of the pulse by subtracting the difference data from the duty cycle data when the fading signal is enabled.

4. The control circuit according to claim 1, further comprising:

a load pan detecting circuit, which is coupled to the pulse generator, receives the pulse, and judges a size of a load pan according to a cycle of the pulse within a predetermined time.

5. The control circuit according to claim 1, further comprising a pulse phase control circuit, which is coupled to the pulse generator and is for controlling the pulse outputted from the pulse generator to have a high potential or a low potential.

6. The control circuit according to claim 1, wherein the pulse generator comprises a fading control terminal and a stop control terminal, and the control circuit further comprises:

a switch circuit having a first input terminal coupled to the output terminal of the second comparator, a second input terminal coupled to the output terminal of the third comparator, a first output terminal coupled to the fading control terminal, and a second output terminal coupled to the stop control terminal, wherein:

when the second input terminal of the second comparator is coupled to the first terminal of the switch element and the second input terminal of the third comparator is coupled to the bridge rectifier, a circuit between the first input terminal and the first output terminal of the switch circuit is turned on, and a circuit between the second input terminal and the second output terminal of the switch circuit is turned on; and when the second input terminal of the second comparator is coupled to the first terminal or the second terminal of the bridge rectifier, and the second input terminal of the third comparator is coupled to the first terminal of the switch element, a circuit between the first input terminal and the second output terminal of the switch circuit is turned on, and a circuit between the second input terminal and the first output terminal of the switch circuit is turned on.

7. The control circuit according to claim 1, wherein the switch element is an insulated gate bipolar transistor (IGBT).

8. The control circuit according to claim 1, wherein the induction heating cooker further comprises:

a capacitor having one terminal coupled to the first terminal of the inductive coil, and the other terminal coupled to the second terminal of the inductive coil.

9. An induction heating cooker, comprising:

an inductive coil having a first terminal coupled to a power voltage;

a switch element having a first terminal coupled to a second terminal of the inductive coil, and a second terminal coupled to a common voltage; and a control circuit, comprising:

a first comparator having a first input terminal coupled to the first terminal of the inductive coil, a second input terminal coupled to the second terminal of the inductive coil, and an output terminal for outputting a trigger signal;

a second comparator having a first input terminal coupled to a first reference voltage, a second input terminal coupled to the first terminal of the switch element, and an output terminal for outputting a fading signal, which is enabled when a voltage of the second input terminal is higher than the first reference voltage;

a pulse generator having an output terminal coupled to a control terminal of the switch element, wherein the output terminal of the pulse generator outputs a pulse to control the switch element when the trigger signal is changed from a second logic level to a first logic level, and the pulse generator reduces a pulse width of the pulse when the fading signal is enabled;

a bridge rectifier comprising a first terminal, a second terminal, a third terminal and a fourth terminal, wherein the first terminal and the second terminal of the bridge rectifier are coupled to an AC voltage source, the third terminal of the bridge rectifier outputs the power voltage, and the fourth terminal of the bridge rectifier outputs the common voltage; and a third comparator having a first input terminal coupled to a second reference voltage, a second input terminal selectively coupled to the first terminal or the second terminal of the bridge rectifier, and an output terminal for outputting a stop signal, wherein:

the stop signal is enabled when a voltage of the second input terminal is higher than the first reference voltage;

the pulse generator is coupled to the output terminal of the third comparator and receives the stop signal; and the pulse generator stops outputting the pulse when the stop signal is enabled.

10. The induction heating cooker according to claim 9, wherein the control circuit comprises:

a low-pass filter, which is coupled between the output terminal of the first comparator and the pulse generator and is for filtering out noise of the trigger signal.

11. The induction heating cooker according to claim 9, wherein the control circuit comprises:

a first register for storing duty cycle data; and a second register for storing difference data, wherein the pulse generator determines a duty cycle of the pulse according to the duty cycle data, and the pulse generator determines the duty cycle of the pulse by subtracting the difference data from the duty cycle data when the fading signal is enabled.

12. The induction heating cooker according to claim 9, wherein the control circuit comprises:

a load pan detecting circuit, which is coupled to the pulse generator, receives the pulse, and judges a size of a load pan according to a cycle of the pulse within a predetermined time.

13. The induction heating cooker according to claim 9, wherein the control circuit comprises a pulse phase control circuit, which is coupled to the pulse generator and is for controlling the pulse outputted from the pulse generator to have a high potential or a low potential.

14. The induction heating cooker according to claim 9, wherein the pulse generator comprises a fading control terminal and a stop control terminal, and the control circuit further comprises:

a switch circuit having a first input terminal coupled to the output terminal of the second comparator, a second input terminal coupled to the output terminal of the third comparator, a first output terminal coupled to the fading control terminal, and a second output terminal coupled to the stop control terminal, wherein:

when the second input terminal of the second comparator is coupled to the first terminal of the switch element and the second input terminal of the third comparator is coupled to the bridge rectifier, a circuit between the first input terminal and the first output terminal of the switch circuit is turned on, and a circuit between the second input terminal and the second output terminal of the switch circuit is turned on; and when the second input terminal of the second comparator is coupled to the first terminal or the second terminal of the bridge rectifier, and the second input terminal of the third comparator is coupled to the first terminal of the switch element, a circuit between the first input terminal and the second output terminal of the switch circuit is turned on, and a circuit between the second input terminal and the first output terminal of the switch circuit is turned on.

15. The induction heating cooker according to claim 9, wherein the switch element is an insulated gate bipolar transistor (IGBT).

16. The induction heating cooker according to claim 9, further comprising:

a capacitor having one terminal coupled to the first terminal of the inductive coil, and the other terminal coupled to the second terminal of the inductive coil.

17. A control circuit for controlling an induction heating cooker, wherein the induction heating cooker comprises an inductive coil, a bridge rectifier and a switch element, the inductive coil is coupled between a power voltage and a first terminal of the switch element, a second terminal of the switch element is coupled to a common voltage, the bridge rectifier comprises a first terminal, a second terminal, a third terminal and a fourth terminal, the first terminal and the second terminal of the bridge rectifier are coupled to an AC voltage source, the third terminal of the bridge rectifier outputs the power voltage, and the fourth terminal of the bridge rectifier outputs the common voltage, the control circuit comprising:

a first comparator having a first input terminal coupled to a first terminal of the inductive coil, a second input terminal coupled to a second terminal of the inductive coil, and an output terminal for outputting a trigger signal;

a third comparator having a first input terminal coupled to a second reference voltage, a second input terminal selectively coupled to the first terminal or the second terminal of the bridge rectifier, and an output terminal for outputting a stop signal, which is enabled when a voltage of the second input terminal is higher than a first reference voltage;

a pulse generator, which is coupled to the first comparator and the output terminal of the third comparator, receives the stop signal and the trigger signal, outputs a pulse to control the switch element when the trigger signal is changed from a second logic level to a first logic level, and stops outputting the pulse when the stop signal is enabled.

18. The control circuit according to claim 17, further comprising:

a second comparator having a first input terminal coupled to the first reference voltage, a second input terminal coupled to the first terminal of the switch element, and an output terminal for outputting a fading signal, which is enabled when a voltage of the second input terminal is higher than the first reference voltage, wherein the pulse generator is coupled to the output terminal of the second comparator, receives the fading signal, and reduces a pulse width of the pulse when the fading signal is enabled.

19. The control circuit according to claim 18, further comprising:

a first register for storing duty cycle data; and a second register for storing difference data, wherein the pulse generator determines a duty cycle of the pulse according to the duty cycle data, and the pulse generator determines the duty cycle of the pulse by subtracting the difference data from the duty cycle data when the fading signal is enabled.

20. The control circuit according to claim 18, wherein the pulse generator comprises a fading control terminal and a stop control terminal, and the control circuit further comprises:

a switch circuit having a first input terminal coupled to the output terminal of the second comparator, a second input terminal coupled to the output terminal of the third comparator, a first output terminal coupled to the fading control terminal, and a second output terminal coupled to the stop control terminal, wherein:

when the second input terminal of the second comparator is coupled to the first terminal of the switch element and the second input terminal of the third comparator is coupled to the bridge rectifier, a circuit between the first input terminal and the first output terminal of the switch circuit is turned on, and a circuit between the second input terminal and the second output terminal of the switch circuit is turned on; and when the second input terminal of the second comparator is coupled to the first terminal or the second terminal of the bridge rectifier, and the second input terminal of the third comparator is coupled to the first terminal of the switch element, a circuit between the first input terminal and the second output terminal of the switch circuit is turned on, and a circuit between the second input terminal and the first output terminal of the switch circuit is turned on.

21. The control circuit according to claim 17, further comprising:

a low-pass filter, which is coupled between the output terminal of the first comparator and the pulse generator and is for filtering out noise of the trigger signal.

22. The control circuit according to claim 17, further comprising:

a load pan detecting circuit, which is coupled to the pulse generator, receives the pulse, and judges a size of a load pan according to a cycle of the pulse within a predetermined time.

23. The control circuit according to claim 17, further comprising a pulse phase control circuit, which is coupled to the pulse generator and is for controlling the pulse outputted from the pulse generator to have a high potential or a low potential.

24. The control circuit according to claim 17, wherein the switch element is an insulated gate bipolar transistor (IGBT).

25. The control circuit according to claim 17, wherein the induction heating cooker further comprises:

a capacitor having one terminal coupled to the first terminal of the inductive coil, and the other terminal coupled to the second terminal of the inductive coil.

26. A control circuit for controlling an induction heating cooker, which comprises an inductive coil and a switch element, wherein the inductive coil is coupled between a power voltage and a first terminal of the switch element, and a second terminal of the switch element is coupled to a common voltage, the control circuit comprising:

a first comparator having a first input terminal coupled to a first terminal of the inductive coil, a second input terminal coupled to a second terminal of the inductive coil, and an output terminal for outputting a trigger signal;

a second comparator having a first input terminal coupled to a first reference voltage, a second input terminal coupled to the first terminal of the switch element, and an output terminal for outputting a fading signal, which is enabled when a voltage of the second input terminal is higher than the first reference voltage;

a pulse generator for outputting a pulse to control the switch element when the trigger signal is changed from a second logic level to a first logic level, and for reducing a pulse width of the pulse when the fading signal is enabled;

a first register for storing duty cycle data; and a second register for storing difference data, wherein the pulse generator determines a duty cycle of the pulse according to the duty cycle data, and the pulse generator determines the duty cycle of the pulse by subtracting the difference data from the duty cycle data when the fading signal is enabled.

27. The control circuit according to claim 26, wherein the induction heating cooker comprises:

a bridge rectifier comprising a first terminal, a second terminal, a third terminal and a fourth terminal, wherein the first terminal and the second terminal of the bridge rectifier are coupled to the AC voltage source, the third terminal of the bridge rectifier outputs the power voltage, and the fourth terminal of the bridge rectifier outputs the common voltage.

28. The control circuit according to claim 27, further comprising:

a third comparator having a first input terminal coupled to a second reference voltage, a second input terminal selectively coupled to the first terminal or the second terminal of the bridge rectifier, and an output terminal for outputting a stop signal, wherein:

the stop signal is enabled when a voltage of the second input terminal is higher than the first reference voltage;

the pulse generator is coupled to the output terminal of the third comparator and receives the stop signal; and the pulse generator stops outputting the pulse when the stop signal is enabled.

29. The control circuit according to claim 26, further comprising:

a low-pass filter, which is coupled between the output terminal of the first comparator and the pulse generator and is for filtering out noise of the trigger signal.

30. The control circuit according to claim 26, further comprising:

a load pan detecting circuit, which is coupled to the pulse generator, receives the pulse, and judges a size of a load pan according to a cycle of the pulse within a predetermined time.

31. The control circuit according to claim 26, wherein the switch element is an insulated gate bipolar transistor (IGBT).

32. The control circuit according to claim 26, wherein the induction heating cooker further comprises:

a capacitor having one terminal coupled to the first terminal of the inductive coil, and the other terminal coupled to the second terminal of the inductive coil.

33. An induction heating cooker, comprising:

an inductive coil having a first terminal coupled to a power voltage;

a switch element having a first terminal coupled to a second terminal of the inductive coil, and a second terminal coupled to a common voltage; and a control circuit, comprising:

a first comparator having a first input terminal coupled to the first terminal of the inductive coil, a second input terminal coupled to the second terminal of the inductive coil, and an output terminal for outputting a trigger signal;

a second comparator having a first input terminal coupled to a first reference voltage, a second input terminal coupled to the first terminal of the switch element, and an output terminal for outputting a fading signal, which is enabled when a voltage of the second input terminal is higher than the first reference voltage;

a pulse generator having an output terminal coupled to a control terminal of the switch element, wherein the output terminal of the pulse generator outputs a pulse to control the switch element when the trigger signal is changed from a second logic level to a first logic level, and the pulse generator reduces a pulse width of the pulse when the fading signal is enabled;

a first register for storing duty cycle data; and a second register for storing difference data, wherein the pulse generator determines a duty cycle of the pulse according to the duty cycle data, and the pulse generator determines the duty cycle of the pulse by subtracting the difference data from the duty cycle data when the fading signal is enabled.

34. The induction heating cooker according to claim 33, further comprising:

a bridge rectifier comprising a first terminal, a second terminal, a third terminal and a fourth terminal, wherein the first terminal and the second terminal of the bridge rectifier are coupled to an AC voltage source, the third terminal of the bridge rectifier outputs the power voltage, and the fourth terminal of the bridge rectifier outputs the common voltage.

35. The induction heating cooker according to claim 34, wherein the control circuit comprises:

a third comparator having a first input terminal coupled to a second reference voltage, a second input terminal selectively coupled to the first terminal or the second terminal of the bridge rectifier, and an output terminal for outputting a stop signal, wherein:

the stop signal is enabled when a voltage of the second input terminal is higher than the first reference voltage;

the pulse generator is coupled to the output terminal of the third comparator and receives the stop signal; and the pulse generator stops outputting the pulse when the stop signal is enabled.

36. The induction heating cooker according to claim 33, wherein the control circuit comprises:

a low-pass filter, which is coupled between the output terminal of the first comparator and the pulse generator and is for filtering out noise of the trigger signal.

37. The induction heating cooker according to claim 33, wherein the control circuit comprises:

a load pan detecting circuit, which is coupled to the pulse generator, receives the pulse, and judges a size of a load pan according to a cycle of the pulse within a predetermined time.

38. The induction heating cooker according to claim 33, wherein the switch element is an insulated gate bipolar transistor (IGBT).

39. The induction heating cooker according to claim 33, further comprising:

a capacitor having one terminal coupled to the first terminal of the inductive coil, and the other terminal coupled to the second terminal of the inductive coil.

40. A control circuit for controlling an induction heating cooker, wherein the induction heating cooker comprises an inductive coil, a bridge rectifier and a switch element, the inductive coil is coupled between a power voltage and a first terminal of the switch element, a second terminal of the switch element is coupled to a common voltage, the bridge rectifier comprises a first terminal, a second terminal, a third terminal and a fourth terminal, the first terminal and the second terminal of the bridge rectifier are coupled to an AC voltage source, the third terminal of the bridge rectifier outputs the power voltage, and the fourth terminal of the bridge rectifier outputs the common voltage, the control circuit comprising:

a first comparator having a first input terminal coupled to a first terminal of the inductive coil, a second input terminal coupled to a second terminal of the inductive coil, and an output terminal for outputting a trigger signal;

a third comparator having a first input terminal coupled to a second reference voltage, a second input terminal selectively coupled to the first terminal or the second terminal of the bridge rectifier, and an output terminal for outputting a stop signal, which is enabled when a voltage of the second input terminal is higher than a first reference voltage;

a pulse generator, which is coupled to the first comparator and the output terminal of the third comparator, receives the stop signal and the trigger signal, outputs a pulse to control the switch element when the trigger signal is changed from a second logic level to a first logic level, and stops outputting the pulse when the stop signal is enabled;

a first register for storing duty cycle data; and a second register for storing difference data, wherein the pulse generator determines a duty cycle of the pulse according to the duty cycle data, and the pulse generator determines the duty cycle of the pulse by subtracting the difference data from the duty cycle data when the fading signal is enabled.

41. The control circuit according to claim 40, further comprising:

a low-pass filter, which is coupled between the output terminal of the first comparator and the pulse generator and is for filtering out noise of the trigger signal.

42. The control circuit according to claim 40, further comprising:

a load pan detecting circuit, which is coupled to the pulse generator, receives the pulse, and judges a size of a load pan according to a cycle of the pulse within a predetermined time.

43. The control circuit according to claim 40, wherein the switch element is an insulated gate bipolar transistor (IGBT).

44. The control circuit according to claim 40, wherein the induction heating cooker further comprises:

a capacitor having one terminal coupled to the first terminal of the inductive coil, and the other terminal coupled to the second terminal of the inductive coil.

* * * * *